US006307511B1

(12) United States Patent
Ying et al.

(10) Patent No.: US 6,307,511 B1
(45) Date of Patent: Oct. 23, 2001

(54) PORTABLE ELECTRONIC COMMUNICATION DEVICE WITH MULTI-BAND ANTENNA SYSTEM

(75) Inventors: Zhinong Ying, Lund; Dag Mårtensson, Flyinge; Kenneth Håkansson, Malmö , all of (SE)

(73) Assignee: Telefonaktiebolaget LM Ericsson, Stockholm (SE)

( * ) Notice: Subject to any disclaimer, the term of this patent is extended or adjusted under 35 U.S.C. 154(b) by 0 days.

(21) Appl. No.: 09/187,966

(22) Filed: Nov. 6, 1998

(30) Foreign Application Priority Data

Nov. 6, 1997 (SE) ..... 9704051

(51) Int. Cl.[7] ..... H01Q 1/24
(52) U.S. Cl. ..... 343/702; 343/700 MS
(58) Field of Search ..... 343/702, 726, 343/700 MS, 895

(56) References Cited

U.S. PATENT DOCUMENTS

| | | | | |
|---|---|---|---|---|
| 4,990,927 | * | 2/1991 | Ieda et al. | 343/700 MS |
| 5,075,691 | * | 12/1991 | Garay et al. | 343/830 |
| 5,337,061 | | 8/1994 | Pye et al. | 343/702 |
| 5,557,293 | * | 9/1996 | McCoy et al. | 343/867 |
| 5,809,433 | * | 9/1998 | Thompson et al. | 455/575 |
| 5,936,587 | * | 8/1999 | Gudilev et al. | 343/752 |
| 5,966,098 | * | 10/1999 | Qi et al. | 343/702 |
| 5,995,052 | * | 11/1999 | Sadler et al. | 343/702 |
| 6,011,519 | * | 1/2000 | Sadler et al. | 343/742 |

FOREIGN PATENT DOCUMENTS

| | | |
|---|---|---|
| 2 291 542 | 1/1996 | (GB) . |
| 2 293 276 | 3/1996 | (GB) . |
| 94/25999 | 11/1994 | (WO) . |
| 96/38882 | 12/1996 | (WO) . |

* cited by examiner

*Primary Examiner*—Don Wong
*Assistant Examiner*—Trinh Vo Dinh
(74) *Attorney, Agent, or Firm*—Burns, Doane, Swecker & Mathis, L.L.P.

(57) ABSTRACT

A portable electronic communication device, such as a mobile telephone, has first and second housing elements, which are moveable relative to each other, and an antenna system for electromagnetic communication within at least two different frequency bands. The antenna system is made by a printed pattern of an electrically conductive material, which is arranged on the second housing element and is connected to elements for radio communication inside the first housing element. A first portion of the printed pattern resonates at a frequency within a first frequency band, and a second portion of the printed pattern resonates at a frequency within a second frequency band.

12 Claims, 5 Drawing Sheets

PORTABLE ELECTRONIC COMMUNICATION DEVICE WITH MULTI-BAND ANTENNA SYSTEM

The present invention relates to a portable electronic communication device, comprising a first housing element, a second housing element, which is movable relative to the first housing element, and an antenna system for electromagnetic communication within at least two different frequency bands.

BACKGROUND

Mobile or cellular telephones are nowadays perhaps the most common examples of portable electronic communication devices according to the above. Many different digital systems for mobile telecommunications have entered the market in recent years. GSM (Global System for Mobile Communication), for instance, is well-spread across virtually all European countries as well as many places in Asia, Australia, and America. Other common examples are DCS (Digital Communications System), PCS (Personal Communications System), etc. Normally, these mobile telecommunications systems operate in different frequency ranges. In Europe, for instance, GSM uses the 890–960 MHz band, while DCS uses 1710–1880 MHz and PCS uses 1850–1990 MHz. In many countries a plurality of systems are used in parallel to each other, normally operating in different frequency bands, and hence the need for multi-band mobile telephones has become all the more urgent. The need is accentuated by the fact that new kinds of mobile telecommunications services, such as home-based wireless telephones, wireless hands-free sets, wireless LANs (operating in the 2,4–2,5 GHz band), etc, are to be introduced in a near future, or are in fact already here. Consequently, there is an obvious and strong need and demand for communication devices with multi-band antennas.

A general dual or multi-band antenna design is for instance disclosed in WO96/38882 (Ericsson Inc.), where a multi-band printed monopole antenna is operative in two different frequency bands thanks to a parasitic element arranged close to the monopole antenna. The monopole antenna is arranged to be placed, in a conventional way, on top of the telephone apparatus housing. The printed monopole antenna is made from a conductive trace with an electric length, such that a primary resonance occurs within a first frequency band. The parasitic element, which has no direct electric connection with the conductive trace, is arranged to tune the conductive trace into a secondary resonance within a second frequency band.

WO94/25999 (Motorola, Inc.) discloses an antenna, which is arranged in the flip of an electronic apparatus, such as a radio telephone. A transformer is arranged at a hinge mechanism to connect the flip to the main apparatus housing. One transformer winding is located in the apparatus housing, while a second winding is located in the flip. The purpose of the transformer is to couple electro-magnetic energy between the antenna in the flip and other electronics located in the apparatus housing as well as to act as an impedance matching element. The antenna according to WO94/25999 is arranged to work in one single frequency band only.

U.S. Pat. No. 5,337,061 (Shaye Communications Ltd) relates to a wireless telephone with a foldable flip pivotally connected thereto. A first antenna is arranged in the flip, and a second antenna is located in the main portion of the telephone, i.e. the apparatus housing. By carefully selecting the design of the two antennas the need has been eliminated for a separate device for switching between the two antennas. However, the two antennas are arranged to operate in the same frequency band, since the telephone according to U.S. Pat. No. 5,337,061 is aimed at obtaining optimum antenna performance during ongoing calls (wherein the first antenna is operative, and the flip is folded down), as well as in stand-by mode (wherein the second antenna is operative, and the flip is folded up).

SUMMARY

An object of the present invention is to provide a portable electronic communication device, comprising a main housing element and a foldable housing element hinged to the former, with a multi-band antenna system with improved efficiency, as compared to the prior art. In particular, the invention is aimed at providing a novel and inventive antenna design for such communication devices, said antenna system being able to operate in at least two different frequency bands without any need for an impedance matching network or a separate device for switching between the frequency bands.

The objects of the invention are achieved by providing the foldable housing element (e.g. a flip) with a printed pattern of an electrically conductive material, wherein a first portion of the printed pattern is arranged to resonate at a frequency within a first frequency band, while a second portion of the printed pattern is arranged to resonate at a frequency within a second frequency band. The printed pattern acts as a multi-band antenna system and is connected to means for radio communication (e.g. radio circuitry) inside the main housing element (e.g. a telephone housing).

Further objects, features and merits of the present invention appear from the following detailed description of several embodiments of the invention, and from the appended subclaims as well as the drawings.

BRIEF DESCRIPTION OF THE DRAWINGS

The present invention will now be described in more detail by way of embodiment examples, reference being made to the acompanying drawings, in which.

DETAILED

Figure 1:
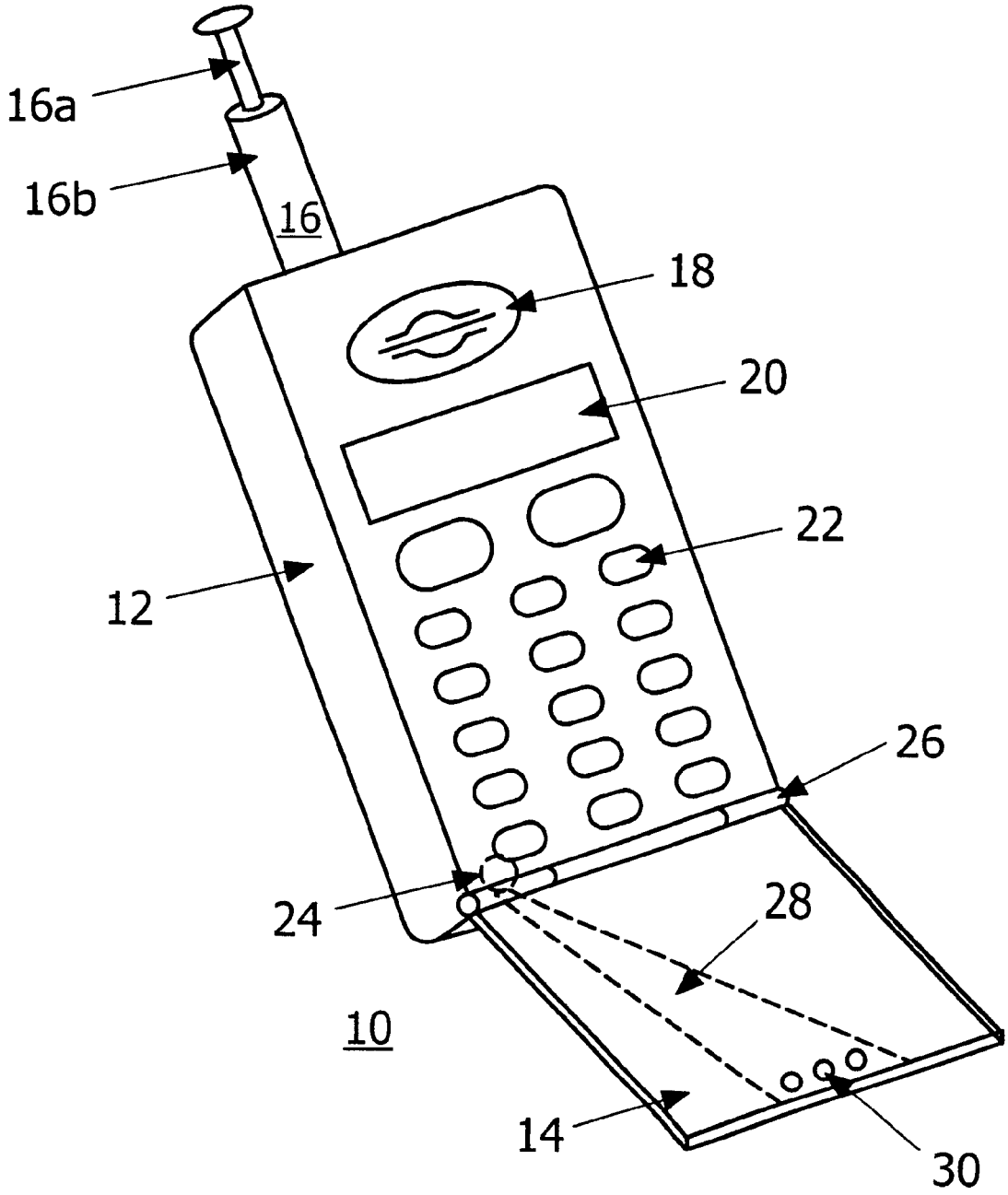
FIG. 1 PRIOR ART
FIG. 1 illustrates a portable mobile or cellular telephone according to the prior art.

In FIG. 1 there is shown a portable electronic communication device 10, or more specifically a mobile telephone, with a multi-band antenna system 16 according to the prior art. The mobile telephone 10 is a conventional cellular telephone, which is arranged to operate in two different frequency bands, such as the GSM band and the PCS band. The telephone 10 comprises an apparatus housing 12 and a foldable flip 14, which is pivotally mounted to the apparatus housing 12 by means of a hinge mechanism 26. In a conventional way the flip 14 will normally be folded up along the apparatus housing 12, thereby covering a lower portion of the front side of the telephone. When the telephone is to be used for answering an incoming call or initiating an outgoing call, the user will fold down the flip 14, so that it takes on a position according to FIG. 1.

The telephone comprises a multi-band antenna system 16, consisting of two antennas 16*a* and 16*b*, wherein the first antenna 16*a* for instance is a retractable whip antenna, while the second antenna 16*b* is a stub or helix antenna. The antenna system 16 is, as appears from FIG. 1, arranged on top of the apparatus housing 12. Furthermore, the telephone comprises an earpiece or loudspeaker 18, a display 20, a keypad 22 and a microphone 24. The microphone 24 is arranged at the bottom of the apparatus housing 12 and is connected to a first end of a sound-guiding channel 28 formed inside the flip 14. A second end of the sound-guiding channel 28 is connected to openings 30 in the flip 14 for receiving acoustic soundwaves from the mouth of the talking user.

Figure 2:
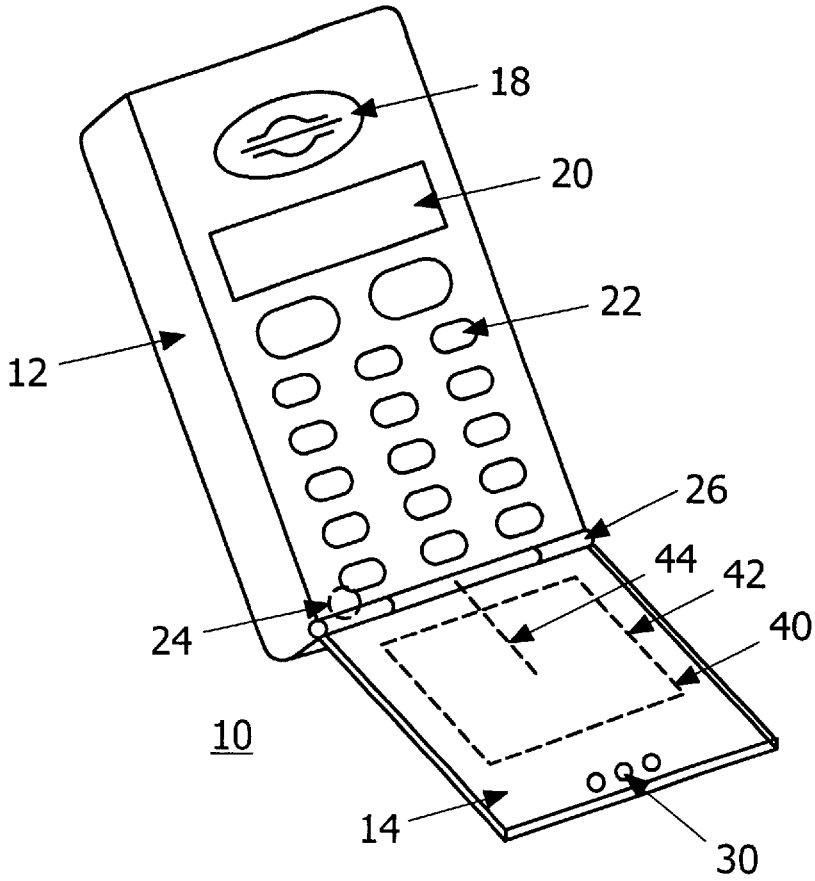
FIG. 2 is a schematic illustration of a portable electronic communication device according to the present invention, FIG. 3 schematically illustrates the operating principle of a multi-band antenna system according to the present invention.

FIG. 2 illustrates, on a schematic level, a portable electronic communication device 10 according to the present invention. The communication device is, for exemplifying but not limiting reasons, illustrated as a mobile telephone, which in similarity to the prior art telephone of FIG. 1 comprises an apparatus housing 12 and a flip 14 pivotally mounted to the former by means of a hinge mechanism 26. Furthermore, the loudspeaker 18, the display 20, the keypad 22 and the microphone 24 are all essentially identical to the corresponding ones in FIG. 1 and hence do not require any further explanation herein. Additionally, in similarity to FIG. 1, the interior of the flip 14 may be provided with a sound-guiding channel extending from sound openings 30 in a lower portion of the flip to the microphone 24, which is located inside the bottom of the apparatus housing 12. For reasons of clarity the sound guiding channel has not been illustrated in FIG. 2.

The major difference between the prior art telephone according to FIG. 1 and the inventive telephone according to FIG. 2 is that the conventional multi-band antenna arrangement 16 in FIG. 1, which is mounted on the upper external surface of the apparatus housing 12, has been replaced by an inventive printed antenna 40, which is arranged on or in the flip 14. The printed antenna 40 is connected to radio circuitry known per se inside the apparatus housing 12 and may hence supply and receive high frequency electric currents to and from the radio circuitry.

Figure 3:
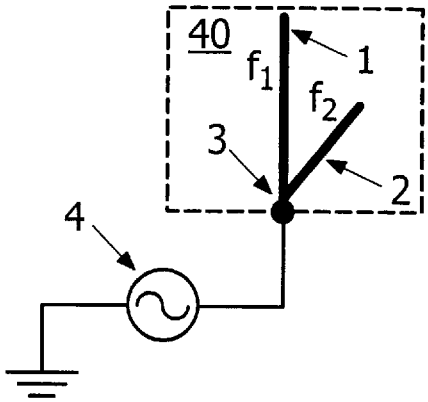

The printed antenna 40 is described on a principal level in FIG. 3. The antenna system 40 comprises a first portion 1 and a second portion 2, both of which are joined at a common node 3. The antenna portions 1 and 2 are fed, through the node 3, by a grounded signal generator 4. In a real-world application the signal generator represents e.g. the radio circuitry in the mobile telephone 10 of FIG. 2. The first portion 1 is resonant at a first frequency $f_1$, while the second portion 2 is resonant at a second frequency $f_2$.

By carefully designing the printed antenna pattern according to the present invention a multi-band antenna with two or more resonant frequencies is obtained, as will be described in more detail below with reference to the different embodiments of the invention. Different portions of the printed antenna pattern are resonant in different frequency bands, and hence the antenna may operate as a multi-band antenna without any impedance matching network or means for switching between the frequency bands. For instance, a triple resonant antenna (GSM, DCS or PCS, and wireless LAN) may be obtained by designing the printed pattern of the antenna accordingly. By varying the printed pattern, the antenna may be given different polarization and may be used as a diversity antenna together with a conventional top-mounted antenna not disclosed herein.

In the schematic example of FIG. 2 a first portion 42 of a printed antenna pattern 40 is resonant at a first frequency within, e.g., the GSM band. A second portion 44 of the pattern 40 is non-resonant and thus inactive for frequencies within this first frequency band.

The second portion 44 is, on the other hand, resonant in a different frequency band, such as the DCS or PCS band at about 1800 MHz, while the first portion 42 is non-resonant and thus inactive for frequencies outside the first frequency band (GSM) at about 900 MHz.

Hence, when the flip is in its opened position according to FIG. 2, the antenna 40 may operate, by means of the portions 42 and 44, respectively, in different frequency bands depending on the frequency of the current supplied from the radio circuitry inside the apparatus housing 12. When the flip is closed, i.e. folded up along the apparatus housing 12, thereby covering the keypad 22, the antenna may still be operative in at least the higher frequency band. A multi-band antenna pattern arranged in the flip according to the present invention has an important advantage, as compared to the prior art, in that the interaction between the human body of the user and the antenna will be substantially reduced, since the distance between the antenna and the human body is larger than the corresponding distance for a prior art telephone according to, e.g., FIG. 1. Thus, the efficiency of the antenna is improved. As an additional advantage the radiofrequent interference with the acoustic circuits inside the apparatus housing is reduced as well. Furthermore, the antenna design proposed according to the invention makes the connection easier between the external antenna and the radio circuitry inside the apparatus housing 12. Another important advantage is that the design of the printed antenna pattern may very easily be modified or adapted to different applications, such as different frequency bands, different polarization, etc. A few examples of such modifications will be described below with reference to the remaining figures.

Figure 4:
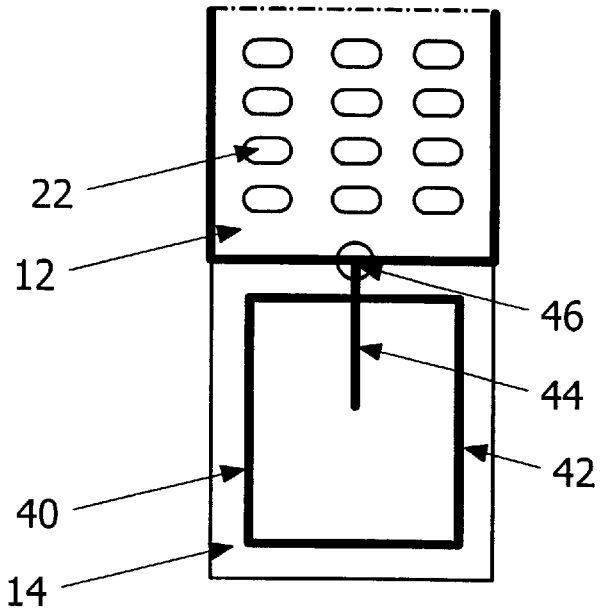
FIG. 4 illustrates a first design, in the form of a Q-type pattern, of a printed antenna pattern according to a first embodiment of the present invention.

In FIG. 4 a first embodiment of the printed antenna pattern according to the present invention is disclosed. As previously described the antenna pattern 40 is constituted by a printed trace of an electric conductor arranged on or inside the flip 14. The pattern may be described as having the shape of a Q character, comprising a large rectangular frame portion 42 and a smaller linear portion 44. The portions 42 and 44 are electrically connected to each other and to the apparatus housing 12 through an external antenna connector 46 arranged close to the hinge mechanism (not disclosed in this figure). The large rectangular portion 42 is resonant within the GSM band (around 900 MHz), and the short linear strip 44 is resonant within the DCS and/or PCS band (around 1800–1900 MHz). In this embodiment the polarization of the antenna 40 will be the same as for a conventional stub antenna.

Figure 5:
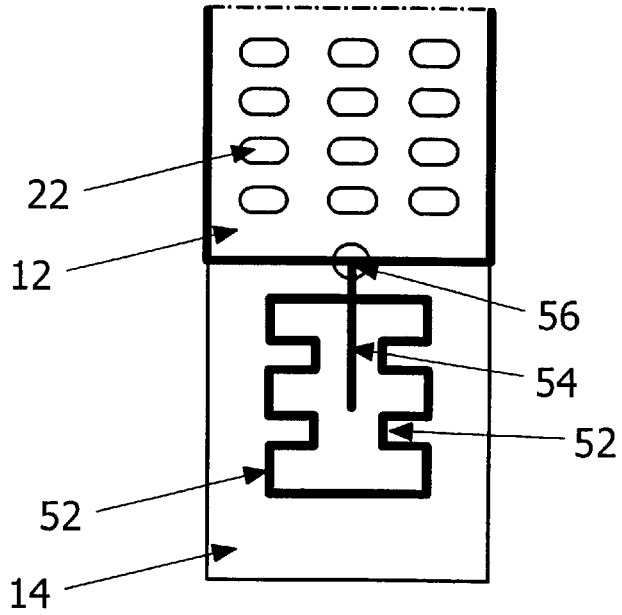
FIG. 5 illustrates an alternative to the printed antenna pattern according to FIG. 4.

FIG. 5 illustrates an alternative version of the embodiment in FIG. 4, namely a modified Q-type pattern. The printed antenna pattern 50 is arranged in or on the flip 14, which in accordance with the above is hinged to the apparatus housing 12. A first large portion 52 of the printed pattern is given a meander shape surrounding a major part of a second smaller portion 54 of the printed pattern 50, said second portion 54 having a linear extention and being connected to the apparatus housing 12 through the external antenna connector 56, in accordance with FIG. 3. The alternative embodiment according to FIG. 5 is particularly suitable for small telephones having a flip of a limited size. The first large portion 52 is resonant the GSM band, while the second smaller portion 54 is resonant within the DCS and/or PCS band.

Figure 6:
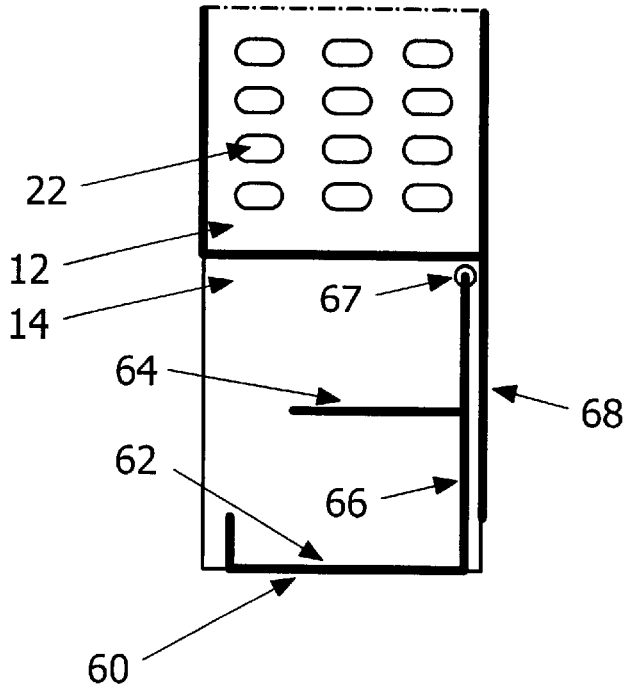
FIG. 6 illustrates a design example for a printed antenna pattern according to an embodiment of the invention, which is particularly adapted for providing polarization diversity.

FIG. 6 illustrates another embodiment of the present invention, wherein the antenna is realized as an unbalanced dipole antenna 60, which has perpendicular polarization as compared to a stub antenna. The unbalanced dipole antenna 60 comprises a first larger branch 62 as well as a second smaller branch 64, both of which are extending perpendicularly to a linear base portion 66 of the printed antenna pattern 60. The base portion 66 is arranged in parallel to a grounded strip 68, which is electrically connected to the apparatus housing 12. The base portion 66 is connected, via an external antenna connector 67, to the radio circuitry inside the apparatus housing 12. Hence, the antenna 60 is of an F-type antenna. The larger branch 62 operates (i.e., resonates) in the GSM band, and the smaller branch 64 operates in the DCS and/or PCS band.

Figure 7:
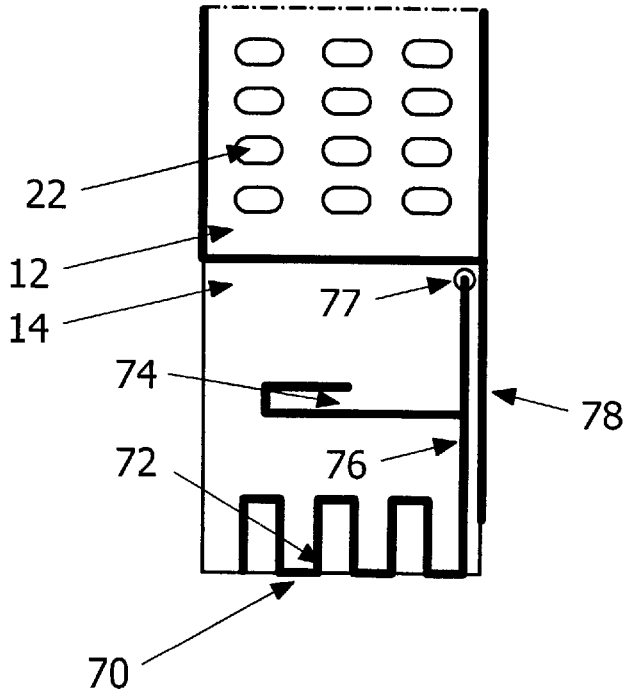
FIG. 7 illustrates an alternative to the printed antenna pattern according to FIG. 6.

FIG. 7 illustrates an alternative to the embodiment in FIG. 6. Here, the larger branch portion 72 as well as the smaller branch portion 74 of the printed antenna pattern 70 are both given a meander shape.

The larger branch portion 72 is, in similarity to the corresponding branch portion 62 in FIG. 6, arranged to resonate at a frequency within the GSM band, while the smaller branch portion 74 is arranged to resonate at a frequency within the higher DCS and/or PCS band. As in FIG. 6, the linear base portion 76 is connected to the external antenna connector 77 and is arranged in parallel to a grounded strip 78 which is connected to the apparatus housing 12.

Figure 8:
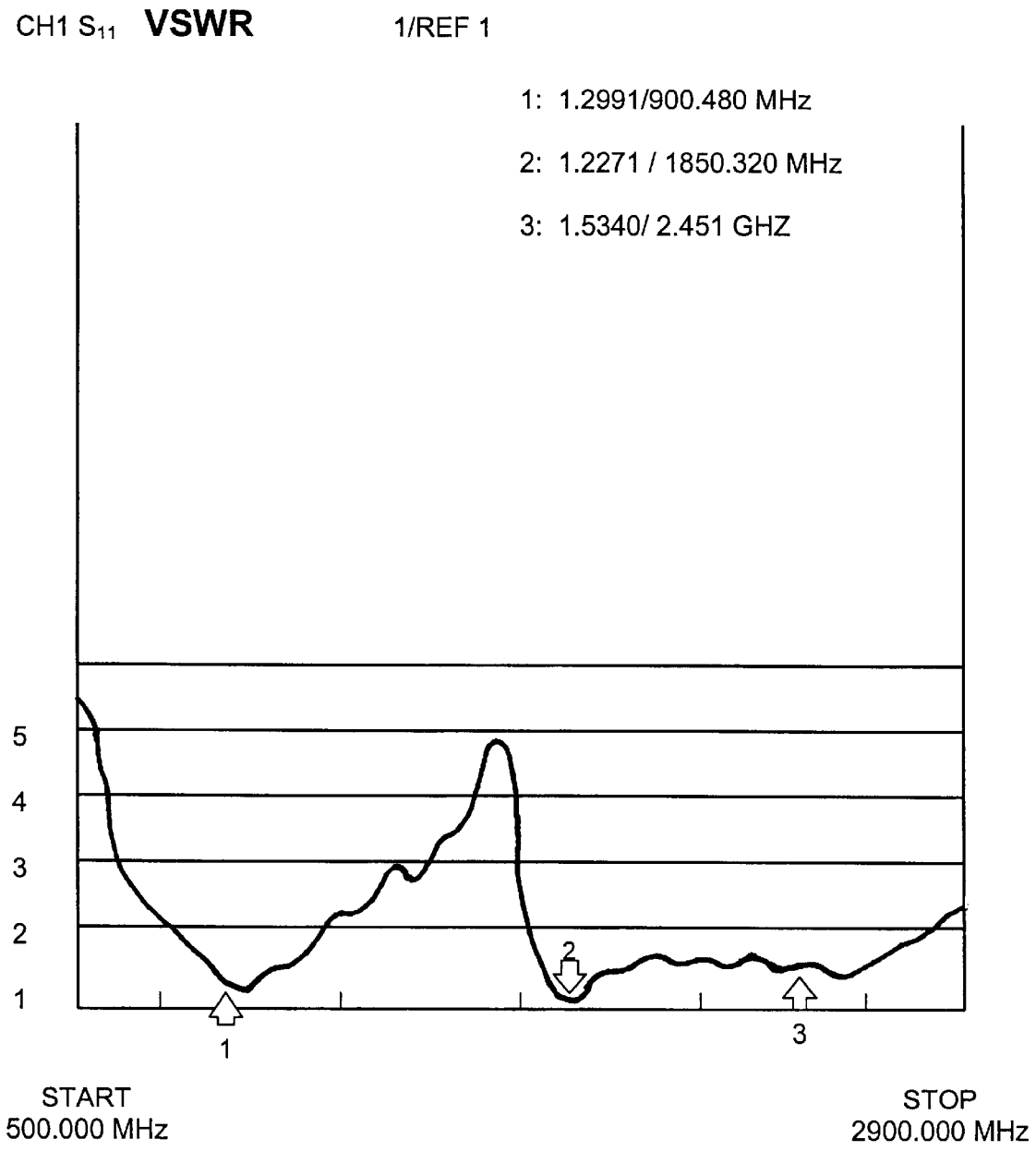
FIG. 8 is a diagram illustrating experimental results obtained for the embodiment according to FIG. 4.

In FIG. 8 a diagram is shown, indicating experimental results obtained for the first embodiment, which was described with reference to FIGS. 2 and 4. These experiments have verified that such a printed flip antenna can be tuned into several resonances. The interval between two resonant frequencies and the bandwidth of each frequency are depening on the design of the pattern of the printed antenna. The lowest resonant frequency (indicated by an arrow 1) is mainly depending on the size of the larger portion of the printed pattern, while a higher resonant frequency (indicated by an arrow 2) is depending on the small portion of the antenna. The large frame portion is resonant as a quarterwave antenna at the GSM band (900 MHz), and the small linear portion is resonant as a quarterwave antenna at the DCS and/or PCS band (1800–1900 MHz). A higher order resonance (indicated by an arrow 3) occurs for the large frame portion, acting as a three-quarterwave antenna, at about 2,4 GHz, which covers the wireless LAN band. The diagram of FIG. 8 illustrates the so called return-loss performance (VSWR), and it appears from the diagram that the Q-type flip antenna according to FIGS. 2 and 4 has a very broad bandwidth. Furthermore, testings as regards radiation pattern in talk position, i.e. when the flip is folded out, have been carried out. These experiments have verified that a flip antenna system according to the present invention has a more uniform radiation pattern as compared to a normal stub antenna system according to the prior art.

The invention has been described above with reference to a set of embodiments, the selection of which has been made for exemplifying reasons only. Hence, the invention shall in no way be regarded to be restricted to these embodiments. On the contrary, the scope of the invention shall be restricted only by the scope of the appended independent patent claims. In particular, it is to be noted that the exemplary frequency bands referred to in the description above, i.e. the GSM, DCS/PCS, and wireless LAN bands, are only to be regarded as examples. Furthermore, the design of the printed antenna pattern may be varied in ways other than the ones disclosed above, as long as the funtional requirements defined by the independent claims are fulfilled. Additionally, the flip may be located on top of the apparatus housing 12, at a long side thereof, etc.

What is claimed is:

1. A portable electronic communication device, comprising:

a first housing element;

a second housing element, which is movable relative to the first housing element;

an antenna system for electromagnetic communication within at least two different frequency bands; and a printed pattern of an electrically conductive material, which is arranged on or in the second housing element and is connected to means for radio communication inside the first housing element, a first portion of the printed pattern being arranged to resonate at a frequency within a first frequency band, a second portion of the printed pattern being arranged to resonate at a frequency within a second frequency band, and the first portion of the printed pattern and the second portion of the printed pattern are directly interconnected at a common feeding point.

2. The device according to claim 1, wherein the first portion of the printed pattern is formed along an endless trace, and the second portion of the printed pattern is formed along a limited trace, so that the first printed pattern portion surrounds at least a major part of the second printed pattern portion.

3. The device according to claim 1, wherein the first printed pattern portion is formed along an endless meander-shaped trace.

4. The device according to claim 1, wherein the first and second portions of the printed pattern are formed as branches extending from a linear base portion of the printed pattern, the linear base portion being arranged adjacent to a grounded strip, which is connected to the first housing element.

5. The device according to claim 4, wherein at least one of the branches of the printed pattern is formed along a meander-shaped trace.

6. The device according to claim 1, wherein the device is a radio telephone.

7. The device according to claim 1, wherein the device is a digital cellular telephone.

8. The device according to claim 7, wherein the first housing element is the main telephone body, and the second housing element is a flip pivotally mounted to the main telephone body by means of a hinge arrangement.

9. The device according to claim 1, wherein the first printed pattern portion is arranged to resonate at a frequency within the GSM band, and the second printed pattern portion is arranged to resonate at a frequency within the DCS or PCS frequency band.

10. A multi-band antenna system for a portable electronic communication device comprising a main apparatus housing and a flip pivotally mounted to the main apparatus portion by means of a hinge mechanism, the antenna system comprising a printed pattern of an electrically conductive material arranged on the flip, a first portion of the printed pattern being arranged to resonate at a frequency within a first frequency band, a second portion of the printed pattern being arranged to resonate at a frequency within a second frequency band, and the first portion of the printed pattern and the second portion of the printed pattern are directly interconnected at a common feeding point.

11. The antenna system according to claim 10, wherein the first frequency band is the GSM band, and the second frequency band is the DCS or PCS band.

12. The antenna system according to claim 10, wherein the portable electronic communication device is a radio telephone or cellular telephone.

* * * * *